US007030183B2

(12) United States Patent
Yamamuro et al.

(10) Patent No.: US 7,030,183 B2
(45) Date of Patent: Apr. 18, 2006

(54) SURFACE TREATING METHOD AND SURFACE TREATING AGENT

(75) Inventors: Masaaki Yamamuro, Tokyo (JP); Mitsuomi Katori, Tokyo (JP)

(73) Assignee: Nihon Hyomen Kagaku Kabushiki Kaisha, Tokyo (JP)

( * ) Notice: Subject to any disclaimer, the term of this patent is extended or adjusted under 35 U.S.C. 154(b) by 556 days.

(21) Appl. No.: 10/237,521

(22) Filed: Sep. 9, 2002

(65) Prior Publication Data

US 2003/0100638 A1 May 29, 2003

Related U.S. Application Data

(62) Division of application No. 09/710,400, filed on Nov. 9, 2002, now Pat. No. 6,500,886.

(30) Foreign Application Priority Data

Nov. 10, 1999 (JP) ..... 11-319339

(51) Int. Cl.
*C08K 3/08* (2006.01)

(52) U.S. Cl. ..... 524/440; 148/247; 148/253; 148/254; 148/255; 148/258; 148/261; 148/273; 205/244; 205/245; 205/246

(58) Field of Classification Search ..... 524/99, 524/440; 148/247, 253, 254, 255, 258, 261, 148/273; 205/244, 245, 246
See application file for complete search history.

(56) References Cited

U.S. PATENT DOCUMENTS

| | | | | |
|---|---|---|---|---|
| 4,411,964 A | | 10/1983 | Hara et al. | 428/626 |
| 4,581,110 A | | 4/1986 | Tsuchida et al. | 204/44.2 |
| 4,644,029 A | * | 2/1987 | Cable et al. | 524/407 |
| 4,655,882 A | | 4/1987 | Hiramatsu et al. | 204/16 |
| 4,861,442 A | | 8/1989 | Nishihama et al. | 204/44.2 |
| 4,889,602 A | | 12/1989 | Oshima et al. | 204/38.1 |
| 4,923,575 A | | 5/1990 | Voss et al. | 204/44.2 |
| 4,983,263 A | | 1/1991 | Yasuda et al. | 204/44.2 |
| 5,248,406 A | | 9/1993 | Kamitani | 205/245 |
| 5,405,523 A | | 4/1995 | Eckles | 205/245 |
| 5,435,898 A | | 7/1995 | Commander et al. | 205/245 |
| 6,179,934 B1 | * | 1/2001 | Kawakami et al. | 148/260 |
| 6,180,177 B1 | * | 1/2001 | Nagashima et al. | 427/388.4 |

FOREIGN PATENT DOCUMENTS

| | | |
|---|---|---|
| AU | 79124/75 | 9/1977 |
| DE | 3506709 A | 9/1985 |
| DE | 3/712511 A | 10/1987 |
| DE | 3/819892 A | 12/1989 |
| EP | 0 531 015 A2 | 3/1993 |
| EP | 839 931 A2 | 5/1998 |
| EP | 839 931 A3 | 8/1998 |
| FR | 2274709 | 2/1976 |
| JP | 61/143597 | 7/1986 |
| JP | 62/238387 A | 10/1987 |
| JP | 1/219188 A | 9/1989 |
| JP | 1/298192 A | 12/1989 |
| JP | 2/141596 A | 5/1990 |
| JP | 2/282493 A | 11/1990 |
| JP | 3/094092 A | 4/1991 |
| JP | 4/259393 A | 9/1992 |
| JP | 7/278875 A | 10/1995 |
| JP | 08-209393 | 8/1996 |
| JP | 2000-282255 | 10/2000 |
| JP | 2001-49484 | 2/2001 |
| JP | 2001-107289 | 4/2001 |
| WO | WO 99/31301 | 6/1999 |
| WO | WO 99/50479 | 7/1999 |
| WO | WO 00/50669 | 8/2000 |

* cited by examiner

*Primary Examiner*—Edward J. Cain
(74) *Attorney, Agent, or Firm*—Marshall, Gerstein & Borun LLP

(57) ABSTRACT

A plating solution containing zinc, an electrically conductive salt, an adsorbent, and at least one of mono- to hexavalent metal ions. A treatment using either a solution which contains, all per liter, 2–60 g Zn, 40–300 g caustic alkali, 0.01–50 g adsorbent, 0.002–10 g Fe, 0.002–10 g Co, 0.05–30 g Mn, 0.001–2 g Cu, 0.005–10 g Ni, 0.002–3 g of at least one chosen from among Mo, W, V, Ti, Al, Ca, Ba, and Sn, and 0.01–30 g aliphatic amine or aliphatic amine polymer or a solution which contains, all per liter, 2–40 g Zn, 40–170 g caustic alkali, 0.01–50 g adsorbent, either 0.001–3 g Fe and 0.001–3 g Co or 0.005–5 g Fe and 0.005–5 g Ni, and 0.01–30 g aliphatic amine or aliphatic amine polymer.

6 Claims, 1 Drawing Sheet

Unit:mm

Unit:mm

SURFACE TREATING METHOD AND SURFACE TREATING AGENT

CROSS REFERENCE TO RELATED APPLICATION

This is a division of U.S. Ser. No. 09/710,400 filed Nov. 9, 2002 now U.S. Pat. No. 6,500,886, the entire disclosure of which is incorporated herein by reference.

BACKGROUND OF THE INVENTION

1. Field of the Invention

This invention relates to the surface treatment of component parts extensively used in various industries manufacturing heavy and light electric machinery and apparatus, household electric appliances, and light and heavy machinery, and in building and construction industries, as well as in automobile, railroad, aircraft, and other transportation industries and, more specifically, to the surface treatment of component members, especially members based on metals, that are required to possess corrosion resistance and fine outward appearance in addition to the properties to be imparted by the surface treatment.

2. Prior Art

Surface treatment with zinc has been a classic method of protecting ferrous materials and component parts against corrosion. To meet a growing demand for enhanced corrosion resistance, surface treatments for improving the zinc treatment have been studied and developed since about a decade or two ago. The new approaches include treatments using zinc alloys, such as zinc-iron, zinc-nickel, zinc-cobalt, zinc-manganese, and tin-zinc alloys, and composite treatments using zinc-silica and the like. Those techniques are more or less effective but still have difficulties to be overcome to comply with more severe requirements in recent years for improved performance. In the art of alloying it is known that increases in the codeposition percentages of iron and nickel as alloying elements (about 13–14% nickel being known to be the best) improve the corrosion resistance of the alloy. In reality, however, alloy plating is done, for example, with a zinc-iron alloy having an iron codeposition percentage of not more than 1% and with a zinc-nickel alloy having a codeposition percentage of about 5–7%. The reasons are that, if the codeposition iron percentage is increased (beyond 1%) in order to meet the demand for greater corrosion resistance, the plating can blister, come off, or otherwise fail to adhere securely upon subjection to load (by secondary operation), such as bending, spiraling, extrusion, indentation, impacting, or rolling of the surface treated work, or upon heating or with the lapse of time. The surface treated members that have had such troubles are no longer of any value as such in respect of corrosion resistance or ornamental effect.

Today, treatment with zinc-nickel alloys having a nickel codeposition percentage of about 13% is in practice in part of the world. The treatment is still unable to provide a basic solution of the afore-described problem of inadequate adhesion on secondary operation. It is hardly applicable to objects whose plating adhesion is challenged by bending, spiraling, extrusion, indentation, impacting, rolling, or other secondary operation after the surface treatment. Another problem is the buildup of waste bath constituents during running, which leads to a drop of current efficiency and hence lower productivity. Among many other problems are the severity of controlling the treating conditions to maintain a narrow codeposition percentage range and the difficulties involved in disposing of the wastewater due to the presence of waste-containing organic matter.

Composite plating with a zinc-silica alloy or the like is being researched in some sectors of industry, primarily for the treatment of sheet steel, but the cases of actual application to component members are only a few. This is because the technique for sheet steel differs widely from that for members; a technique for treating a flat sheet steel is unable to plate evenly members of complex configurations. Moreover, a sheet steel treatment with a zinc-silica system is not directly applicable to component members since it provides an outward appearance inferior in fineness and luster, due to substantial irregularities of the treated surface for which silica is responsible and also to uneven distribution of silica particles about 0.1 μm in size that coagulate in the matrix. The zinc-silica composite treatment imparts improved corrosion resistance with an increase in the silica content. On the other hand, an increase in the deposit further deteriorates the outward appearance of the treated surface, and this makes the composite treatment less suitable for the surface treatment of component members. Thus the composite treatment is practically unable to establish compatibility between high corrosion resistance and fine outward appearance.

By way of example, Japanese Patent Application Kokai No. 61–143597 describes in its Example 2 a zincate plating solution to which fine silica particles are added. The plating solution cannot be used in the plants for the surface treatment of component members to which the present invention is applicable. The reasons include: (1) suspension of minute silica particles in the plating solution, and (2) the minute silica particles present in the plating surface produce surface unevenness and thereby mar the appearance. In the plants where component members are plated, the plating solution tanks are provided with many lines for connection with filters and circulating pumps to maintain the purity and temperature of the solution. If minute silica particles are suspended in the plating solution, they readily clog the filters and get them out of use, rendering it difficult to keep the solution clean. Choked lines would not only make it impossible to maintain the solution at a predetermined temperature but also destroy pumps and other facilities in extreme cases. It might be considered possible to reduce the proportion of minute silica particles so as to enhance the appearance of the treated surface. However, as will be understood from a comparison of the above Example with the rest of examples of the invention (Pat. App. Kokai No. 61-143597), a decrease in the silica content in a plating is accompanied with a corresponding decrease in the corrosion resistance, and it is an attempt at merely reducing the advantageous effect of the cited invention. By way of reference it may be added that, whereas the plating according to Example 2 is 18 μm thick, a thickness range of 5–8 μm is predominant for ordinary platings for component members. In this sense the thickness range of the cited invention differs to a substantial extent from the practical range. The corrosion resistance life of a zinc plating until red rusting is generally proportional to the thickness of the plating. If the plating performance value in Example 2 of the invention (Pat. App. Kokai No. 61-143597) is simply multiplied by 5/18 and the plating thickness is converted to 5 μm, then the period of time until red rusting will be 66.7 hours. Since ordinary zinc plating is said to be corrosion-resistant for 7.5–8 hours per μm of thickness, it follows that a plating 5 μm thick has a pre-rusting duration of about 40 hours. From this slightness of performance difference it is manifest that a further decrease of the minute silica particle content will have the danger of eliminating the effectiveness of the Pat. App. Kokai No.

61-143597 upon ordinary zinc plating. In other words, as the cited invention stands, the minute silica particle content cannot be increased because it will further deteriorate the outward appearance nor can be decreased for fear of reduced corrosion resistance.

In view of these problems, another invention was made to avoid the suspension in a plating solution (i.e., to make the solution clear through dissolution of silica) by restricting the concentration of caustic soda and the proportion of silica particle seeds. At laboratory level the invention in question settled the problems of plating appearance and suspension in plating solution. At actual site in a plant the suspension in plating solution sometimes occurred during extended non-operation time such as year-end and New Year's holidays. Thus the second invention too presented the problems of the Pat. App. Kokai No. 61–143597 or could not preclude that possibility. It is easily expected that the second invention cannot solve the problem of suspension during downtime by the addition of nickel, cobalt, or other metal, and in fact the invention has proved that it cannot. In addition, component members plated with a solution of the invention, with the addition of iron, tended to have the uneven appearance that is given by a silver-free surface treating agent; the members could not have a finely black colored surface unless silver was used.

It is an object of the present invention to settle the problems of the prior art that have been left unsolved. Zinc alloy plating and composite zinc plating have hitherto been studied in order to comply with the growing demand for higher corrosion resistance. In the case of zinc alloy plating, an increase in the alloy component concentration will increase the alloy proportion in the plating and improve the corrosion resistance. However, the plating will not serve its purpose because of deterioration in adhesion and other physical properties (while, of course, reduction of the alloy proportion will lower the corrosion resistance). In composite zinc plating, an increase in the dispersant concentration (an increase in the precipitate proportion in the plating) will enhance the corrosion resistance but will further affect the outward appearance that is originally inferior (while a decrease in the dispersant concentration naturally deteriorate the corrosion resistance).

It is another object of the present invention to overcome this dilemma and provide a plating solution, plating method, and surface treating agent that will impart higher corrosion resistance, better physical properties, and finer appearance than heretofore.

A further object of the invention is to provide a surface treatment which is easier to control than before in preventing the suspension or settlement of the plating solution, in maintaining a broader temperature range, and in avoiding the deterioration performance in the course of running, while giving a fine black appearance more easily than conventional techniques.

BRIEF SUMMARY OF THE INVENTION

After our intensive research, it has now been found that the problems of the prior art can be solved by performing a treatment using either a solution which contains, all per liter, from 2 to 60 g zinc, from 40 to 300 g caustic alkali, from 0.01 to 50 g adsorbent, from 0.002 to 10 g iron, from 0.002 to 10 g cobalt, from 0.05 to 30 g manganese, from 0.001 to 2 g copper, from 0.005 to 10 g nickel, from 0.002 to 3 g of at least one chosen from among molybdenum, tungsten, vanadium, titanium, aluminum, calcium, barium, and tin, and from 0.01 to 30 g aliphatic amine or aliphatic amine polymer or a solution which contains, all per liter, from 2 to 40 g zinc, from 40 to 170 g caustic alkali, from 0.01 to 50 g adsorbent, either from 0.001 to 3 g iron and from 0.001 to 3 g cobalt or from 0.005 to 5 g iron and from 0.005 to 5 g nickel, and from 0.01 to 30 g aliphatic amine or aliphatic amine polymer.

DETAILED DESCRIPTION OF THE INVENTION

Figure 1:
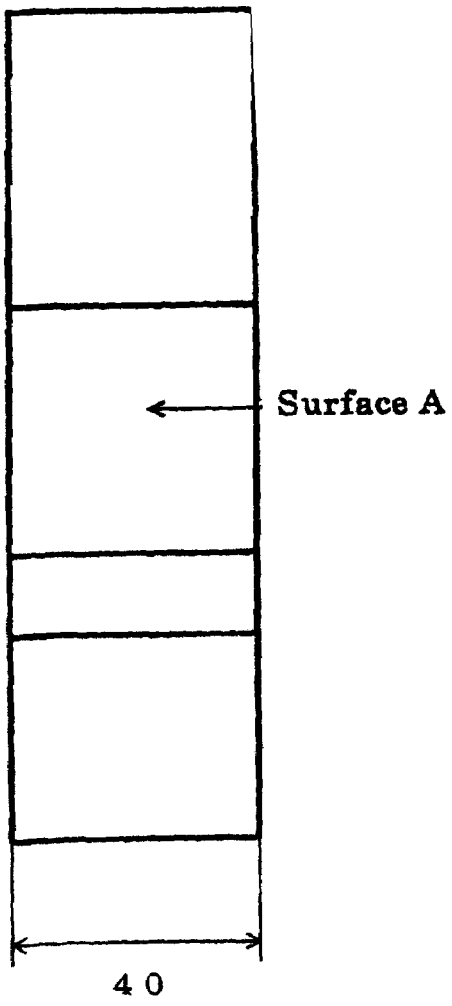
FIG. 1 is a front view of a sheet iron test specimen bent to a complex configuration.
Figure 2:
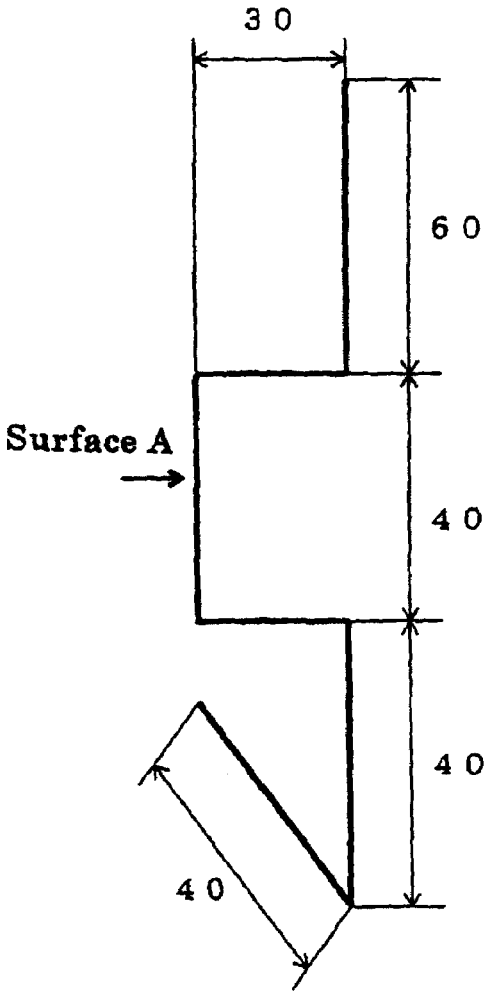
FIG. 2 is a side view of the specimen.

The functions of the constituents will now be explained. Zinc is a substance that forms the basis of the invention and is a principal metal of platings according to the invention. The zinc concentration ranges from 2 to 60 g, preferably from 5 to 30 g, more preferably from 8 to 20 g, per liter. The farther the zinc concentration deviates from the above ranges, the less it is balanced with the other codeposits. Moreover, a lower zinc concentration retards the electrodeposition rate and lowers the productivity. A higher zinc concentration, on the other hand, increases the loss of the solution by dipping out and the like.

As for the concentration of caustic alkali, the range is between 40 and 300 g, preferably between 60 and 220 g, per liter. If the caustic alkali is limited to caustic soda, a more preferable range is between 70 and 170 g/L. If the caustic alkali concentration is below the specified range, component members can hardly be plated uniformly. If the concentration is above the range, discoloration known as alkali yellowing is likely to occur while, at the same time, the solution becomes so viscous that the loss due to dipping out increases.

The adsorbent content ranges from 0.01 to 50 g, preferably from 0.1 to 40 g, per liter. If it is insufficient the advantageous effects of the invention are no longer achieved, and if excessive the outward appearance is deteriorated, again with no effect of the invention. Useful adsorbents include: fluorescent pigments; resins; carbon; divided metals (powders and flakes); metal oxides such as zinc oxide and zinc dioxide; carbides such as silicon carbide, titanium carbide, tungsten carbide, and chromium carbide; nitrides such as boron nitride; borides; and sulfides such as molybdenum disulfide. Of these, an inorganic compound, inorganic colloid, or inorganic sol, e.g., alumina sol, zeolite, silicate sol, zirconium sol, or titanium oxide, especially sodium silicate, alumina sol, or colloidal silica, is desirable. The term "adsorbent" as used herein means an agent by which iron, cobalt, manganese, nickel and the like are adsorbed from a plating solution rather than an agent which is adsorbed by a plating surface according to the invention. In conventional alloy plating, metals in a plating solution are chemically strongly combined with chelating agents (stabilizer and complexing agent). Under the invention it is scarcely deemed appropriate to consider that the adsorbent and metals are as strongly combined as ordinary chelating agents and metals. It is rather more appropriately presumed that the state is as if organic matter is adsorbed by activated charcoal or as if slightly electrically charged substances are attracted by each other.

The adsorbent is useful, first of all, in adsorbing iron, cobalt, manganese, copper, nickel, etc. from a solution and thereby preventing the escape of these metals in the form of hydroxides and the like out of the system. Another favorable effect is that slight deposition of these metals presumably enhances the corrosion resistance to some extent. Last, as the most important role under the invention, it strengthens the plating adhesion. It appears by presumption that the presence of a proper amount of an adsorbent in accordance with the invention permits alloy plating with such high metal codeposition rates that have hitherto been practically impossible, and hence improves the adhesion of the resulting plating. It improves the adhesion, for example, when one or more metals chosen from among iron, cobalt, manganese, copper and nickel coexist in amounts greater than the ordinary limits in a plating. The improved adhesion may be attributed to any of three causes, as the case may be; a direct increase in the adhesive forces between a plating and the base material surface, an action to relieve the stresses and strains produced by the excessive coexistent metals, or softening the plating (making it ductile and stretchable) compared with ordinary platings because of a new ternary alloy (three-element metal). At this writing it is difficult to identify the exact cause. The limitation of the adsorbent amount not only maintains a favorable appearance but also inhibits its aggregation and settlement that result from the presence of the adsorbent to excess. The limitation is further effective in preventing its segregation in a plating. Uneven distribution of the adsorbent in a plating hardens the film (and results in non-uniform distribution of stresses), thus deteriorating the adhesion and marring the appearance.

Generally a decrease in the amount of an adsorbent present is believed to result in lower corrosion resistance. According to the present invention, however, a relatively small adsorbent amount can produce a greater corrosion resistance than usual. This is ascribable to the fact that, with less metal addition than the level in a conventional zinc alloy plating, the present invention achieves as high a codeposition rate as the ordinary zinc alloy plating. The plating formed in compliance with the invention is considered to exhibit high performance because the performance of zinc alloy plating is combined with the performance of an adsorbent. A far more important feature of the invention is that it provides a plating with good adhesion and high metal codeposition rate that have seldom been achieved in the past. Under the invention a chelating agent is an optional component and an adsorbent used instead allows metals to be present at higher codeposition percentages than before, whereby, generally speaking, a rather better performance than usual is now attained. The high performance plating that has scarcely been obtained in the part is now realized by accepting the expected drop of performance rather than by anticipating a synergetic corrosion resistance effect of the combination of high metal concentrations (codeposition percentages) and high adsorbent (e.g., silica) content. Stated differently, a performance far more than had been anticipated has now been attained by accepting the expected performance drop, or reduced corrosion resistance effect, due to a decrease in the adsorbent concentration. Control of the adsorbent concentration apparently influences favorably the adhesion of the plating too. In prior art inventions that use high concentrations of adsorbents such as silica, the adsorbents are presumably distributed unevenly as large aggregates in matrices. It is also presumed that, by contrast, a decrease in the adsorbent concentration according to the present invention makes it scarcely possible to produce aggregation or form large aggregates (uneven distribution in the plating). Finely divided and uniformly and thoroughly distributed silica or the like, in contrast with much unevenly distributed one, apparently acts to relieve the stresses and strains produced by excessively deposited metals as referred to above and acts to strengthen the adherence between the plating and the substrate throughout the object. Uneven distribution of the adsorbent in a plating poses the possibility of creating stresses and strains by itself. The afore-described factors of the invention has now settled the adhesion problem of the prior art and has realized high metal codeposition percentages that were practically unachievable. Consequently, not merely the applications of articles treated with high metal codeposition percentages have now been extended but also the synergetic effect of the high metal percentages with the presence of silica or the like, though at a low concentration, has obviously rendered it possible to attain greater performance than heretofore. Incidentally, inorganic sol, inorganic gel, colloidal silica or the like is deemed to differ in its state of presence before the addition and after the addition to a plating solution. For example, colloidal silica is presumed to be present as a sodium silicate alone or as an aggregate of a suitable number of the molecules.

Suitable concentrations of metals, all per liter, are from 0.002 to 10 g iron, from 0.002 to 10 g cobalt, from 0.05 to 30 g manganese, from 0.001 to 2 g copper, and from 0.005 to 10 g nickel (especially when iron and cobalt coexist, from 0.001 to 3 g iron and from 0.001 to 3 g cobalt or, when iron and nickel coexist, from 0.005 to 5 g iron and from 0.005 to 5 g nickel). When the concentration of any of the metals is more or less than the specified range, a drop of corrosion resistance results. There is no special limitation to the form and way in which the metals are to be supplied. The metals may be supplied in the form of their salts, e.g., sulfates, acetates, nitrates, hydrochlorides, or carbonates, or as complex salts. For cost reason, the plates, blocks, balls, parts, etc. of the metals may be melted by immersion for supply. For faster melting an electric charge (especially plus charge) may be applied to them, or they may be replaced with a dissimilar metal on the surface or may be brought into contact with a dissimilar metal.

From 0.1 to 30 g of an aliphatic amine or aliphatic amine polymer per liter of a plating solution is effective in improving the outer appearance (luster and leveling) of the plating and the throwing power of the solution. If the concentration is below the range these favorable effects are not attained, and if it is excessive the plating rate slows down to an economical disadvantage. Examples of useful aliphatic amines are pentaethylene hexamine, diaminobutane, diaminopropane, diethylenetriamine, ethylaminoethanol, aminopropylethylenediamine, bisaminopropylpiperazine, hexamethylenetetramine, isopropanolamine, aminoalcohol, imidazole, picoline, piperazine, methylpiperazine, morpholine, hydroxyethylaminopropylamine, tetramethylpropylenediamine, dimethylaminopropylamine, hexamethylenetetramine monoethanolamine, diethanolamine, triethanolamine, ethylenediamine, tetramethyldiaminobutane, diaminopropane, monomethylamine, dimethylamine, trimethylamine, diethylenetriamine, tetramethylpropylenediamine, dimethylpropylenediamine, tri-n-butylamine, dimethylaminopropylamine, isopropanolamine, diisopropanolamine, triisopropanolamine, monomethylamine, diethylamine, trimethylamine, hexamethylenetetramine, pentaethylenehexamine, imidazole, methylimidazole, dimethylimidazole, pyridine, aminopyridine, aminoethylpyridine, piperazine, aminopiperazine, aminoethylpiperazine, morpholine, aminopropylmorpholine, piperidine, monomethylpiperidine, aminoethylpiperidine, urea, pyrrolidine, thiourea, and their reaction products. Useful aliphatic amine polymers include reaction products of aliphatic amines, reaction products of aliphatic amines and glycidyl compounds, aminoalcohols, polyaminesulfones, polyethyleneimines, polyalkylenepolyamines, urea-alkylamine reaction products, their alkylation products, reaction products of the above compounds and epihalohydrins or diethylether compounds, quaternary amine-urea compounds, quaternary amine-thiourea compounds, their reaction products, reaction products of the above with nicotinic acid, uric acid, urea, and thiourea, reaction products of the above that have been methylated or ethylated, polymers represented by the structural formula (1)

(2)

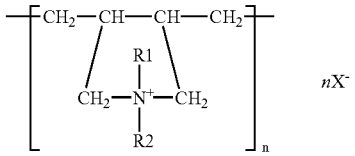

in which R1 and R2 are hydrogen atom or a $C_{<10}$ alkyl each, polymers represented by the structural formula (2)

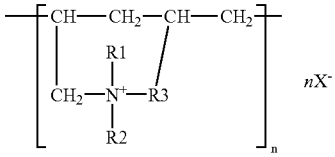

in which R1 and R2 are hydrogen, methyl, ethyl, butyl, or isobutyl each and R3 is $CH_2$, $C_2H_4$, or $C_2H_n$, polymers represented by the structural formula (3)

struc.form. (3)

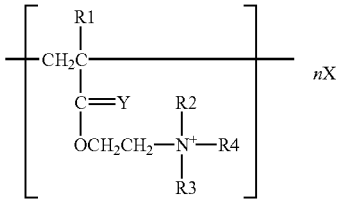

in which R1, R2, R3, and R4 are hydrogen or $C_{<5}$ alkyl each, Y is S or O, and X is an inorganic cation, polymers represented by the structural formula (4)

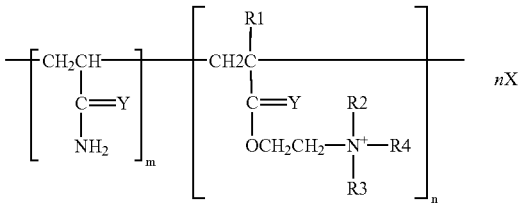

in which R1, R2, R3, and R4 are hydrogen or $C_{<5}$ alkyl each, Y is S or O, and X is an inorganic cation, polymers represented by the structural formula (5)

(II)

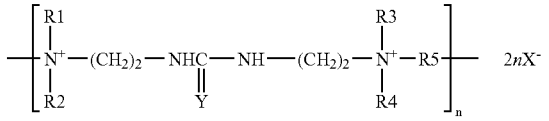

in which R1, R2, R3, and R4 are each chosen from among hydrogen, methyl, ethyl, isopropyl, 2-hydroxylethyl-$CH_2CH_2$-$(OCCH_2CH_2)_xOH$ (x is 0 to 6), and 2-hydroxylethyl-$CH_2CH_2$—$(OCH_2CH_2)_xOH$ (x is 0 to 6), R5 is chosen from among $(CH_2)_2$—O—$(CH_2)_2$, $(CH_2)_2$—O—$(CH_2)_2$—O—$(CH_2)_2$, and $CH_2$—CHOH—$CH_2$—O—$CH_2$—CHOH—$CH_2$, n is 1 or more, Y is S or O, and Z is 1 to 5, polymers represented by the structural formula (6)

(2)

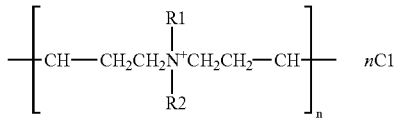

in which R1 and R2 are each chosen from among hydrogen, methyl, ethyl, isopropyl, 2-hydroxylethyl-$CH_2CH_2$ $(OCCH_2CH_2)_xOH$ (x is 0 to 6), and 2-hydroxylethyl-$CH_2CH_2(OCH_2CH_2)_xOH$ (x is 0 to 6), and n is 1 or more, polymers represented by the structural formula (7)

(4)

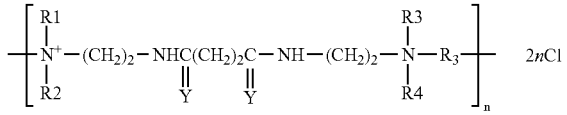

in which R1, R2, R3, and R4 are each chosen from among hydrogen, methyl, ethyl, isopropyl, 2-hydroxylethyl-$CH_2CH_2$—$(OCCH_2CH_2)_xOH$ (x is 0 to 6), and 2-hydroxylethyl-$CH_2CH_2$—$(OCH_2CH_2)_xOH$ (x is 0 to 6), R5 is chosen from among $(CH_2)_2$—O—$(CH_2)_2$, $(CH_2)_2$—O—$(CH_2)_2$—O—$(CH_2)_2$, and $CH_2$—CHOH—$CH_2$—O—$CH_2$—CHOH—$CH_2$, n is 1 or more, Y is S or O, and Z is 1 to 5, polymers composed of monomers represented by the structural formula (8)

(5)

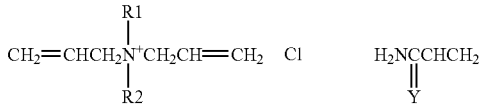

in which R1 and R2 are each chosen from among hydrogen, methyl, ethyl, isopropyl, 2-hydroxylethyl-$CH_2CH_2$ $(OCCH_2CH_2)_xOH$ (x is 0 to 6), and 2-hydroxylethyl-$CH_2CH_2(OCH_2CH_2)_xOH$ (x is 0 to 6), and Y is S or O, benzylpyridinium carboxylate, polyamides, thioacetamide, thioacetamide derivatives, thiourea, thiourea derivatives, urea, urea derivatives, polyallylamines, their copolymers and block polymers. Examples of glycidyl compounds are epichlorohydrin, allylglycidyl ether, butylglycidyl ether, phenylglycidyl ether, glycidol, methylglycidyl ether, 2-ethylhexylglycidyl ether, glycerol diglycidyl ether, ethylene glycol diglycidyl ether, secondary-butylphenol diglycidyl ether, and glycidyl methacrylate.

For enhanced properties the solution may contain any of aldehydes, nitrogen heterocyclic six-membered ring compounds, epihalohydrins reaction products, urea reaction products, thiourea reaction products, PVAs and their reaction products, and various other ingredients used as brighteners in conventional zinc (zinc alloy) plating. A substance known as a chelating agent (stabilizer or complexing agent) may be added besides. In order to obtain a treating agent with sufficiently high metal codeposition percentages to ensure the good physical properties that characterize the present invention, however, the amount of what is known as a chelating agent (stabilizer or complexing agent) should be limited to a suitable minimum. The substances commonly called chelating agents (stabilizers or complexing agents) are amines, amine polymers, citric acid, tartaric acid, gluconic acid, and other carboxylic acids, and saccharides such as sucrose. Typical of them are concretely referred to in Japanese Patent Application Kokai Nos. 62-240788, 62-287092, 4-259393, 62-238387, 2-141596, 5-112889, 1-298192, 2-282493, 3-94092, 1-219188, 2-118094, 60-181293, and 7-278875. It is basically possible to add other chelating agents than those mentioned in the foregoing patents. Examples of aldehydes are dichlorobenzaldehyde, ethylhydroxyaldehyde, octylaldehyde, o-chlorobenzaldehyde, p-chlorobenzaldehyde, p-hydroxybenzaldehyde, acetaldehyde, anisaldehyde, ethylvanillin, cinnamaldehyde, salicylaldehyde, vanillin, peratolualdehyde, heliotropin, and benzaldehyde. Examples of nitrogen heterocyclic six-membered ring compounds are pyridine compounds, including those referred to in EPO649918A1 (U.S. Pat. No. 5,417,840).

After plating with a solution containing above, the plated article is subjected to a surface treatment once or a plurality of times with a treating agent containing at least one of the elements selected from the group consisting of Mo, W, V, Nb, Ta, Ti, Al, Ni, Li, Na, Mg, K, Ca, Co, Cu, Mg, Mn, Ca, Ba, Fe, Sn, Zr, Ce, Sr, Cr, Zn, Ag, Si, P, S, N, Cl, and F, and optionally a carboxylic acid such as malonic, succinic, glycolic, formic, acetic, oxalic, tartaric, and citric acids, nitrogen compounds, saccharides such as sucrose, alcohols, ethers, and other organic substances. In this way even higher antirusting effects can be achieved. Proper amounts of these ingredients to be contained vary with the individual substances and their combination, but usually a total amount between 0.0001 and 70% is contained in the treating agent. In consideration of the viscosity, economy, and performance of the resulting solution, a range between about 0.001 and about 15% is in most cases found appropriate.

Of the treating agents, those using Cr often give relatively favorable results. Combinations of Cr with an acid such as sulfuric acid, nitric acid, hydrochloric acid, hydrogen peroxide, or fluoric acid, and such combinations with the further addition of acetic acid, formic acid, citric acid, succinic acid, ascorbic acid, malonic acid, tartaric acid or other carboxylic acid, sulfamic acid or other similar acid, urea, amine, or phosphoric acid give relatively good results too. It is further possible to combine them with Ti, Co, Ni, any of alkaline earth metals, Ag, Zn, Si or the like. Among possible combinations are Cr-nitric acid-cobalt, Cr-sulfuric acid-titanium, and such combinations with a carboxylic acid and/or silicon. Compositions in which Cr is replaced by another metal, e.g., W, V, Ti, Al, Ni, Li, Mg, Co, Mn, Fe, Sn, Zr, or any of alkaline earth metals tend to show relatively desirable properties. In addition, there are combinations of molybdenum, titanium, nickel, iron, aluminum or the like and phosphoric acid, combinations of titanium and silicon compounds, and combinations of silicon compounds and any of alkali metals and alkaline earth metals. Furthermore, treatment is possible using a treating agent which consists of acrylic resin, Teflon resin, silicate resin, epoxy resin or other organic/inorganic resin as a matrix and any of the above-mentioned substances or substances (e.g., aluminum, titanium, zinc, molybdenum, their oxides, nitrides, sulfides, and silicon compounds, and Teflon) dispersed in the form of flakes or powder into the matrix. When treatment with such a treating agent is to be performed a plurality of times, the second or/and subsequent treatments may use another surface treating agent containing Mo, W, V, Nb, Ta, Ti, Al, Ni, Li, Na, Mg, K, Ca, Co, Cu, Mg, Mn, Ca, Ba, Fe, Sn, Zr, Ce, Sr, Cr, Zn, Ag, Si, P, S, N, Cl, F, metal sulfide, carbon, resin, polyethylene wax, alcohol, ether, pigment, dye, torque adjusting agent, or/and conductivity-imparting agent. In this manner a surface treatment can be accomplished with better functions (enhanced corrosion resistance, improved design quality, impartment of electric conductivity, and control of friction and torque coefficients). These is no special limitation to the sources of the above substances to-be supplied. Various sources may be used, including metal sulfates, nitrates, hydrochlorides, and other salts, silicate compounds, silane compounds, oxy-acid salts, complex salts, nitrides, oxides, and sulfites. Examples of these combinations are combinations of Si and at least one of alkali metals, alkaline earth metals, transition metals, polyethylene waxes, dyes, alcohols, and resins; and combinations with at least one of resins, conductivity-imparting agents, pigments, torque adjusting agents, alcohols, and ethers.

The method of treating with one of the treating agents exemplified above comprises plating of an object with a plating solution according to the present invention, and treating the plated object by contacting it once or a plurality of times with a treating agent of the invention. When the object is contacted only once with the treating agent, the treated object is either water washed after the contacting or is not water washed but is dried or baked in the next step. For the drying purpose it is possible to allow the article to stand at room temperature or to dehydrate it with revolution; further application of heat between about 50 and 120° C. is more common. When baking is resorted to, the temperature usually ranges from about 120 to 300° C. When the object is contacted with a treating agent twice, there are two alternative procedures: (1) After contacting with the treating agent, contacting the object with a second treating agent in the next step, with or without prior water washing, and further, with or without water washing, drying or baking the twice-treated object. (2) After contacting with the treating agent, drying or baking the object, with or without prior water washing, contacting the object with another treating agent, and further, with or without water washing, drying or baking the object. The first and second treating agents may be the same or different. When the treatment is repeated thrice or more, the procedure is basically the combination of the afore-described procedures of one- and two-time treatments. For example, the contacting and baking may be repeated twice using one and the same treating agent and then carrying out the final contacting and baking with a different treating agent or, as an alternative, different treating agents may be used in the individual process steps.

Contacting with a treating agent in many cases is done by dipping, but coating or spraying may be used instead. Further, the dipping may be combined with electrolysis.

The present invention will now be more fully described in connection with its examples. Unless otherwise stated, each test was conducted by pretreating a sheet iron complexly bent as shown in FIG. 1, treating it in accordance with the present invention, and the results were evaluated. As in conventional practice, the test specimen was water washed between the required steps. Not a single solution used showed suspension (settlement), and each solution after plating was allowed to stand for 30 days and showed no change (settlement).

EXAMPLE 1

Plating was carried out using sheet iron as the anode, with a solution containing, all per liter, 10 g zinc oxide, 100 g sodium hydroxide, 2 g polymer of the structural formula (1) (R1, R2=methyl, n=120–450, molecular weight=about 30000), 0.8 g ethylenediamine-epichlorohydrin reaction product, 0.05 g ethylvanillin, 30 g No. 3 sodium silicate (made by Nissan Chemical Ind. Co.), 0.01 g cobalt, 0.1 g iron, and 0.05 g thiourea. The sheet iron test specimen was bent back to the original shape as flat as possible, and there was no trace of exfoliation or peeling off from the former folds. The specimen was immersed for 25 seconds in a treating solution which contained 5 g potassium bichromate, 1 g sulfuric acid, and 0.4 g sodium nitrate per liter and then dried at 60° C. Three test specimens plated on the side A to a thickness of about 5 μm were prepared and subjected to a salt water spray test to determine the corrosion resistance on the side A of the specimens. The time periods they took to form white rust that characterizes zinc rust ranged from 960 to 1320 hours and the periods they took to form red rust as corrosion of iron ranged from 2352 to 2880 hours.

EXAMPLE 2

Plating was done using sheet iron as the anode, with a solution containing, all per liter, 40 g zinc oxide, 180 g potassium hydroxide, 2 g polymer of the structural formula (2) (R1, R2=CH3, R3=CH2, n=150–800, molecular weight=about 50000, X=chlorine), 0.1 g pentaethylenehexamine-epichlorohydrin reaction product, 0.06 g vanillin, 15 g colloidal silica (made by Nissan Chemical Ind. Co., "Catalloid 20"), and 0.1 g iron. The sheet iron was immersed for 60 seconds in a treating solution which contained 3 g chromium acetate, 0.5 g sodium sulfate, 0.5 g sodium nitrate, and 2 g phosphoric acid per liter and then immersed for 20 seconds in a treating solution which contained 60 g sodium silicate, 10 g sodium hydroxide, and 0.04 g zinc per liter, and dried. Three test specimens plated on the side A to a thickness of about 5 μm were prepared and they were tested for their corrosion resistance on the side A by salt water spraying. The time periods they took to form white rust as zinc rust were 720–1160 hours and the periods they took to form red rust as corrosion of iron were 2352–2880 hours.

EXAMPLE 3

Plating of sheet iron was performed with zinc plate as the anode, using a solution which contained, all per liter, 7.5 g zinc oxide, 70 g sodium hydroxide, 0.4 g reaction made by dimethylaminopropylenediamine and epichlorohydrin, 0.3 g imidazole-epichlorohydrin reaction product, 0.03 g benzylpyridinium carboxylate, 1.5 g polymer of the structural formula (3) (R1, R2, R3, R4=methyl, Y=O, n=150–200, molecular weight=about 28000, X=chlorine), 0.05 g anisaldehyde, 40 g No. 3 sodium silicate, 0.015 g iron, and 0.01 g cobalt. The sheet iron test specimen was bent back to the original shape as flat as possible, and there was no trace of exfoliation or peeling off from the former folds. The specimen was immersed for 30 seconds in a treating solution which contained 3 g potassium bichromate, 2 g chromic acid, 1 g nitric acid, 1 g sulfuric acid, and 50 g acetic acid per liter and then dried at 60° C. Three test specimens plated on the side A to a thickness of about 5 μm were prepared and subjected to a salt water spray test to determine the corrosion resistance on the side A of the specimens. The time periods they took to form white rust as zinc rust were 886–1320 hours and the periods they took to form red rust as iron rust were 2400–2880 hours.

EXAMPLE 4

Plating was conducted using a solution which contained, all per liter, 21.5 g zinc oxide, 140 g sodium hydroxide, 0.6 g reaction made by dimethylaminopropylenediamine and epichlorohydrin, 0.3 g imidazole-epichlorohydrin reaction product, 0.03 g benzylpyridinium carboxylate, 1.5 g polymer of the structural formula (4) (R1, R2, R3, R4=methyl, Y=O, m=30000–50000, n=10000–30000, molecular weight=about 3000000–6000000, X=chlorine), 0.04 g heliotropin, 30 g No. 3 sodium silicate, and 0.03 g nickel. The plated specimen was immersed for 40 seconds in a treating solution which contained 3 g chromium nitrate, 0.4 g titanium sulfate, 0.3 g nitric acid, 0.2 g sulfuric acid, and 0.1 g acid ammonium fluoride per liter, and then immersed for 20 seconds in a chemical film treating agent "5G018" (made by JASCO) which contained 0.02 g zinc and 20 g sodium silicate per liter and was dried at 70° C. The test specimen was bent back to the original shape as flat as possible, and there was no trace of exfoliation or peeling off from the former folds. Three test specimens plated on the side A to a first layer thickness of about 5 μm were prepared and subjected to a salt water spray test to determine the corrosion resistance on the side A of the specimens. The time periods they took to form white rust as zinc rust were 960–1400 hours and the periods they took to form red rust as iron rust were 2440–2960 hours.

EXAMPLE 5

Plating was conducted using a solution which contained, all per liter, 10 g zinc oxide, 140 g sodium hydroxide, 1.9 g polymer of the structural formula (5) (R1, R2, R3, R4=methyl, R5=—$C_2H_4$—O—$C_2H_4$—, Y=O, Z=2, n=4–9, X=chlorine), 0.02 g anisaldehyde, 30 g colloidal silica, 0.02 g iron, and 0.5 mL commercially available brightener for zincate plating "8500" (made by JASCO). The plated specimen was immersed for 60 seconds in a treating solution which contained 6 g potassium bichromate, 4 g chromic acid, 2 g nitric acid, 1.5 g sulfuric acid, and 80 g acetic acid per liter, and then immersed for 20 seconds in a treating solution which contained 0.1 g chromic acid and 0.05 g phosphoric acid per liter and was dried at 60° C. The iron codeposition percentage of the test specimen was 1.7%. The test specimen was bent back to the original shape as flat as possible, and there was no trace of exfoliation or peeling off from the former folds. Three test specimens plated on the side A to a thickness of about 5 μm were prepared and subjected to a salt water spray test to determine the corrosion resistance on the side A of the specimens. The time periods they took to form white rust as zinc rust were 860–1320 hours and the periods they took to form red rust as iron rust were 2424–2880 hours. No inadequate adhesion was observed with the lapse of time.

EXAMPLE 6

Plating was conducted using nickel as the anode, with a solution which contained, all per liter, 8 g zinc oxide, 110 g sodium hydroxide, polymer of the structural formula (7) (R1, R2, R3, R4=methyl, R5=—$C_2H_4$—O—$C_2H_4$—, Y=O, Z=3, n=70–120, X=chlorine), 0.03 g benzylpyridinium carboxylate, 0.05 g veratraldehyde, 4 g No. 3 sodium silicate, 0.5 mL commercially available brightener for zincate plating "8500" (made by JASCO), and 0.04 g nickel. The plated specimen was immersed for 50 seconds in a treating solution which contained 1 g titanium sulfate, 2 g ammonium molybdate, 2 g phosphoric acid, 1 g hydrogen peroxide, and 10 g colloidal silica per liter. It was then immersed for 30 seconds in a chemical film treating agent "Stron C coat" (made by JASCO) and was dried at 100° C. The test specimen was bent back to the original shape as flat as possible, and there was no trace of exfoliation or peeling off from the former folds. Three test specimens plated on the side A to a thickness of about 5 μm were prepared and subjected to a salt water spray test to determine the corrosion resistance on the side A of the specimens. The time periods they took to form white rust as zinc rust were 960–1200 hours and the periods they took to form red rust as iron rust were 2880–3000 hours.

EXAMPLE 7

Plating was performed using a solution which contained, all per liter, 12 g zinc oxide, 110 g sodium hydroxide, 2 g block polymer of polymers having the structural formula (5) in which R1, R2, R3, R4=methyl, R5=—$C_2H_4$—O—$C_2H_4$—, Y=O, n=2–7 in common, and Z=2 and 3, 0.3 g imidazole-epichlorohydrin reaction product, 0.05 g anisaldehyde, 2 g No. 3 sodium silicate, 0.004 g iron, and 0.003 g cobalt. The test specimen was bent back to the original shape as flat as possible, and there was no trace of exfoliation or peeling off from the former folds. The specimen was immersed for 50 seconds in a treating solution which contained 3 g chromic acid, 2 g sulfuric acid, 1 g nitric acid, and 2 g phosphoric acid per liter and was dried at 70° C. Three test specimens plated on the side A to a thickness of about 5 μm were prepared and subjected to a salt water spray test to determine the corrosion resistance on the side A of the specimens. The time periods they took to form white rust as zinc rust were 800–1140 hours and the periods they took to form red rust as iron rust were 2880–3000 hours.

EXAMPLE 8

Plating was done using a solution which contained, all per liter, 30 g zinc oxide, 160 g sodium hydroxide, 1.9 g polymer of the structural formula (5) (R1, R2, R3, R4=methyl, R5=—$C_2H_4$—O—$C_2H_4$—, Y=O, Z=3, n=4–9, X=chlorine), 0.02 g veratraldehyde, 35 g colloidal silica, 0.15-g iron, 0.5 mL commercially available brightener for zincate plating "8500" (made by JASCO), and 10 mL commercially available additive for zincate plating "H-0624" (made by JASCO). The plated specimen was immersed for 60 seconds in a treating solution which contained 3 g potassium bichromate, 2 g chromic acid, 0.2 g nitric acid, 1.5 g sulfuric acid, and 10 g phosphoric acid per liter. It was then immersed for 20 seconds in another treating solution containing 0.5 g chromic acid and 0.05 g phosphoric acid per liter and was dried at 60° C. The iron codeposition percentage of the specimen was 1.3%. The test specimen was bent back to the original shape as flat as possible, and there was no trace of exfoliation or peeling off from the former folds. Three test specimens plated on the side A to a first layer thickness of about 5 μm were prepared and subjected to a salt water spray test to determine the corrosion resistance on the side A of the specimens. The time periods they took to form white rust as zinc rust were 860–1368 hours and the periods they took to form red rust as iron rust were 2448–2880 hours. No inadequate adhesion was observed with the lapse of time.

EXAMPLE 9

Plating was conducted using a solution which contained, all per liter, 11 g zinc oxide, 110 g sodium hydroxide, 1.5 g polymer of the structural formula (6) (R1, R2=methyl, n=5–10, X=chlorine), 1 g polymer of the structural formula (2) (R1, R2=$CH_3$, R3=$CH_2$, n=150–180, molecular weight=about 50000, X=chlorine), 0.2 g dimethylamine-epichlorohydrin reaction product, 0.5 g benzylpyridinium carboxylate, 0.02 g anisaldehyde, 25 g colloidal silica, 25 g polyethyleneimine, 5 g sodium gluconate, and 6.8 g nickel. The plated specimen was immersed for 70 seconds in a treating solution which contained 10 g potassium bichromate, 5 g chromic acid, 3 g sulfuric acid, 1 g hydrochloric acid, and 15 g phosphoric acid, per liter, and then was immersed for 20 seconds in a treating solution containing 0.8 g chromic acid and 0.05 g phosphoric acid per liter. It was further immersed for 30 seconds in a chemical film treating agent "Stron C coat" (made by JASCO) and was dried at 100° C. Three test specimens plated on the side A to a thickness of about 5 μm were prepared and subjected to a salt water spray test to determine the corrosion resistance on the side A of the specimens. The time periods they took to form white rust as zinc rust were 1440–1860 hours and the periods they took to form red rust as iron rust were 3120–3840 hours.

EXAMPLE 10

Plating was done using a solution which contained, all per liter, 15 g zinc oxide, 150 g sodium hydroxide, 1.9 g polymer of the structural formula (5) (R1, R2, R3, R4=methyl, R5=—$C_2H_4$—O—$C_2H_4$—, Y=O, Z=3, n=4–9, X=chlorine), 0.02 g veratraldehyde, 10 g colloidal silica, 2.5 g iron, 1.5 g cobalt, 1 g polymer of the structural formula (2) (R1, R2=$CH_3$, R3=$CH_2$, n=150–180, molecular weight=about 50000, X=chlorine), 15 g sodium tartarate, and 5 g commercially available iron stabilizer for zinc-iron alloy plating "Base R" (made by JASCO). The plated specimen was immersed for 45 seconds in a treating solution which contained 7 g potassium bichromate, 5 g chromic acid, 2 g sulfuric acid, 1 g hydrochloric acid, and 20 g phosphoric acid, per liter, and then was immersed for 20 seconds in a treating solution containing 0.5 g chromic acid and 0.1 g acetic acid. It was further immersed for 30 seconds in a chemical film treating agent "Stron J coat" (made by JASCO) and was dried at 80° C. Three test specimens plated on the side A to a thickness of about 5 μm were prepared and subjected to a salt water spray test to determine the corrosion resistance on the side A of the specimens. The time periods they took to form white rust as zinc rust were 1200–1680 hours and the periods they took to form red rust as iron rust were 2808–3120 hours.

EXAMPLE 11

Plating was carried out using a solution which contained, all per liter, 18.75 g zinc oxide, 145 g sodium hydroxide, 2 g polymer of the structural formula (2) described in Example 10, 4 g polymer of the structural formula (5) described in Example 10, 0.1 g 2-aminopyridine-epichlorohydrin reaction product, 0.01 g ethylvanillin, 0.015 g iron, and 15 g No. 3 sodium silicate. Plated test specimens were treated with different treating solutions, i.e., those containing, all per liter, (1) 30 g chromium nitrate, 30 g sodium nitrate, and 50 g phosphoric acid; (2) 30 g chromium sulfate, 3.54 g nitric acid, and 1 g titanium sulfate; (3) 50 g chromium nitrate, 1 g sulfuric acid, 1 g titanium sulfate, and 50 g colloidal silica; (4) 50 g chromium nitrate, 1 g nitric acid, 15 g malonic acid, and 2 g cobalt nitrate; (5) commercially available black chromate treating agent for zinc-iron alloy plating "FB-965S" (made by JASCO); and (6) 2 g aluminum sulfate, 2 g titanium sulfate, 2 g magnesium nitrate, 8 g phosphoric acid, and 20 g No. 3 sodium silicate. The specimens treated with (1) to (3) were further treated with an alkali solution containing 300 g colloidal silica per liter, and the specimens treated with (4) to (6) were further treated, respectively, with a chemical film treating agent "5G018" (made by JASCO), a commercially available finishing agent for black chromate treatment "RB-775" (made by JASCO), and a chemical film treating agent "Stron C coat" (made by JASCO). The test specimens treated under the varied conditions were further divided into three specimens each, with a plating on the side A to a thickness of about 5 μm and subjected to a salt water spray test to determine the corrosion resistance on the side A of the specimens. The time periods they took to form white rust as zinc rust were 1248–1680 hours and the periods they took to form red rust as iron rust were 2332–3600 hours.

COMPARATIVE EXAMPLE 1

Zinc-nickel alloy plating to a Ni codeposition percentage of 14% was conducted using a commercially available chemical for zinc-nickel alloy plating ("Stron Ni zinc chemical" made by JASCO) with proper adjustment of the Ni concentration in the treating solution. The plated surface showed a somewhat inferior appearance with a blackish-gray matte. The plating was observed to come off partly upon bending. It was further treated using a commercially available chromate treating agent "ZNC-980C" (made by JASCO) under the conditions specified in its catalog (at 25° C. for 30 sec.), but a sound film could not be formed. A corrosion resistance test by salt water spraying showed that the specimens resisted only 120–168 hours before developing white rust. A test specimen with a codeposition percentage of 6% which showed good appearance and adhesion was chromate treated, and it took 480 hours to show white rust and 2160 hours to show red rust.

COMPARATIVE EXAMPLE 2

A zinc-iron alloy plating with an iron codeposition percentage of 1.2% was obtained using a commercially available chemical for zinc-iron alloy plating ("Stron zinc" chemical made by JASCO) and adjusting the iron concentration in the solution. It showed unusual bright appearance and was found to come off partly upon heating or bending or with the lapse of time. When it was treated with a commercially available black chromate treating agent for zinc-iron alloy plating "FB-965S" (made by JASCO) under standard conditions stated in its catalog, an uneven inferior appearance resulted. A test specimen with a codeposition percentage of 0.4% which had good appearance and adhesion was chromate treated, and it showed corrosion resistance of 480 hours before white rusting and 1920 hours before red rusting.

COMPARATIVE EXAMPLE 3

A plating solution was prepared by adding 4 ml of a commercially available additive (brightener "8500" made by JASCO) and 50 g of fine silica powder having a particle diameter of 18 mμ ("Bitaseal #1500" made by Taki Seihi K.K.) per liter to a solution containing 13 g zinc oxide and 110 g sodium hydroxide per liter. Plating was carried out using zinc as the anode while uniformly stirring the solution because it had been suspended, and a plating layer about 5 μm thick was formed on the side A of test specimens. One test specimen was immersed for 30 seconds in a treating solution which contained, all per liter, 1 g potassium bichromate, 0.2 g sulfuric acid, 0.2 g nitric acid, and 0.1 g phosphoric acid to obtain Test specimen A. Another specimen was immersed for 30 seconds in a treating solution which contained, all per liter, 2 g nickel sulfate, 10 g colloidal silica, and 0.2 g nitric acid to obtain Test specimen B. Another specimen was treated in the same way as B and was further immersed for 20 seconds in a treating solution which contained, all per liter, 30 g colloidal silica, 5 g sodium hydroxide, and 0.01 g zinc and then dried at 60° C. to obtain Test specimen C. All three specimens were less bright than the specimens of Examples of the invention and, with pear-like sprinkled skin, inferior in outward appearance.

The corrosion resistance values on the side A of the test specimens were as follows. The time periods required for white rusting were 240–360 hours for Test specimen A, 120–192 hours for Test specimen B, and 360–480 hours for Test specimen C. The time periods required by Test specimens A, B and C for red rusting were 480–600 hours, 360–480 hours, and 480–600 hours, respectively.

COMPARATIVE EXAMPLE 4

Plating was carried out using zinc as the anode, with a solution (pH 4) which contained, all per liter, 288 g white vitriol, 25 g boric acid, 27 g ammonium chloride, 50 g of fine silica powder having a particle diameter of 18 mμ ("Bitaseal #1500" made by Taki Seihi K.K.), 0.001 mL nonionic surfactant (polyoxyethylenelaurylamine), and 0.0005 M cationic surfactant (dodecyltrimethylammonium chloride), while thoroughly stirring the solution which had been suspended. Thus a plating layer about 5 μm thick was formed on the side A of test specimens. Partial holidays had occurred at that point. One test specimen was immersed for 35 seconds in a treating solution which contained, all per liter, 5 g ammonium molybdate, 15 g phosphoric acid, 2 g titanium sulfate, 3 g hydrogen peroxide, and 15 g colloidal silica to obtain Test specimen A. Another specimen was immersed for 60 seconds in a treating solution which contained, all per liter, 3 g chromium acetate, 0.1 g sulfuric acid, 0.1 g nitric acid, and 2 g phosphoric acid to obtain Test specimen B. Another specimen was treated in the same way as B and was further immersed for 20 seconds in a treating solution which contained, all per liter, 60 g sodium silicate, 10 g sodium hydroxide, and 0.04 g zinc to obtain Test specimen C.

All three specimens were far less bright than the specimens of Comparative Example 3 and were inferior in outward appearance with pear-like sprinkled skin.

Their corrosion resistance values in terms of the time periods required for white rusting were 24–48 hours for Test specimen A, 72–120 hours for Test specimen B, and 120–168 hours for Test specimen C. The time periods required by Test specimens A, B and C for red rusting were 240–288 hours, 288–360 hours, and 360–480 hours, respectively. The holiday or unplated surface regions developed red rust within 8 hours.

COMPARATIVE EXAMPLE 5

A test specimen similar to the specimen of Example 1 was made by following the same procedure except that 100 g No. 3 sodium silicate per liter was added to the plating solution of Example 1. Another similar test specimen was made by the procedure of Example 1 except that 100 g colloidal silica per liter was added to the solution of Example 1. The colloidal silica in the plating solution did not dissolve completely but remained suspended and formed more sediment the next day. The solution that contained No. 3 sodium silicate formed much sediment in about one week. In either case the plating solution was of very little practical value. The plated specimens lacked brightness and were inferior in appearance with pear-like sprinkled skin. The specimens were then treated with a commercially available black chromate treating agent for zinc-iron alloy plating "FB-965S" (made by JASCO) under standard conditions specified in its catalog. The treated specimens had uneven outward appearance with insufficient blackness and appreciable interference colors.

COMPARATIVE EXAMPLE 6

A test specimen was made in the same way as described in Example 1 with the exception that No. 3 sodium silicate was excluded from the plating solution of Example 1. A large amount of hydroxides of metals such as iron floated on the bath. With the deposition of the floated substances the plated specimen had a dirty outward appearance.

COMPARATIVE EXAMPLE 7

Plating was conducted with a solution which contained, all per liter, 10 g zinc oxide, 120 g sodium hydroxide, 8 mL commercially available brightener for zincate zinc plating "8500" (made by JASCO), 100 g colloidal silica, and 0.02 g iron. The plated specimen was treated with a commercially available black chromate treating agent for zinc-iron alloy plating "FB-965S" (made by JASCO) under standard conditions specified in its catalog and then with a commercially available finishing agent for black chromate treatment "RB-775" (made by JASCO) again under standard conditions according to its catalog. The treated specimen had uneven outward appearance with insufficient blackness and appreciable interference colors. In order to increase the blackness the iron concentration was increased to 0.1 g per liter but the plating was as uneven as with 0.02 g iron. The sheet iron test specimen was bent back to the original shape as flat as possible, when the former bends showed slight exfoliation and removal of the plating. With the lapse of time the plating partly came off. The solution was allowed to stand for testing, and in about 10 days sediment was found in the solution.

What is claimed is:

1. A surface treatment method comprising the steps of (a) treating the surface of an object with a plating solution containing zinc, an electrically conductive salt, an adsorbent, and at least one of monovalent to hexavalent ions, and then (b) treating the treated surface once or a plurality of times with a surface treating agent solution containing at least one element chosen from the group consisting of Mo, W, V, Nb, Ta, Ti, Al, Ni, Li, Na, Mg, K, Ca, Co, Cu, Mn, Ba, Fe, Sn, Zr, Ce, Sr, Cr, Zn, Ag, Si, P, S, N, Cl, and F.

2. The surface treating method of claim 1, wherein said surface agent contains from 0.001 g to 200 g per liter of at least one element chosen from the group consisting of Mo, W, V, Nb, Ta, Ti, Al, Ni, Li, Na, Mg, K, Ca, Co, Cu, Mn, Ba, Fe, Sn, Zr, Ce, Sr, Cr, Zn, Ag, Si, P, S, N, Cl, and F and optionally an organic substance or substances, nitrogen compounds, saccharides, alcohols, and ethers.

3. The surface treating method of claim 2 wherein said surface treating agent includes a carboxylic acid.

4. The surface treating method of claim 3 wherein the carboxylic acid is selected from the group consisting of malonic acid, succinic acid, glycolic acid, formic acid, acetic acid, oxalic acid, tartaric acid, and citric acid.

5. The surface treating method of claim 2 including sucrose.

6. The surface treating method of claim 2 comprising the additional step of treating the surface of the object after the treating steps with an additional surface treating agent containing at least one member selected from the group consisting of Mo, W, V, Nb, Ta, Ti, Al, Ni, Li, Na, Mg, K, Ca, Co, Cu, Mn, Ba, Fe, Sn, Zr, Ce, Sr, Cr, Zn, Ag, Si, P, S, N, Cl, F, metal sulfides, carbons, resins, polyethylene waxes, alcohols, ethers, pigments, dyes, torque adjusting agents, and conductivity-imparting agents.

* * * * *

UNITED STATES PATENT AND TRADEMARK OFFICE

CERTIFICATE OF CORRECTION

PATENT NO. : 7,030,183 B2
APPLICATION NO. : 10/237521
DATED : April 18, 2006
INVENTOR(S) : Yamamuro et al.

It is certified that error appears in the above-identified patent and that said Letters Patent is hereby corrected as shown below:

In the Title Page:

Related U.S. Application Data (62): "November 9, 2002" should be --November 9, 2000--.

In the Specification:

At column 1, line 8, "2002" should be --2000--.

Signed and Sealed this

Fifth Day of September, 2006

JON W. DUDAS
*Director of the United States Patent and Trademark Office*